US009579876B1

(12) United States Patent
Maeda et al.

(10) Patent No.: US 9,579,876 B1
(45) Date of Patent: Feb. 28, 2017

(54) PRINTING MECHANISM

(71) Applicant: Siko Co., Ltd., Osaka (JP)

(72) Inventors: Hirotoshi Maeda, Osaka (JP); Takashi Fujioka, Osaka (JP)

(73) Assignee: SIKO CO., LTD., Osaka (JP)

( * ) Notice: Subject to any disclaimer, the term of this patent is extended or adjusted under 35 U.S.C. 154(b) by 0 days.

(21) Appl. No.: 15/014,577

(22) Filed: Feb. 3, 2016

(51) Int. Cl.
*B41F 3/54* (2006.01)

(52) U.S. Cl.
CPC ..... *B41F 3/54* (2013.01)

(58) Field of Classification Search
CPC ..... B41F 27/00; B41F 13/00; B41F 13/10; B41F 13/08
See application file for complete search history.

(56) References Cited

U.S. PATENT DOCUMENTS 4,258,113 A * 3/1981 Kuehnle ..... G03G 5/10 204/192.25
4,461,663 A * 7/1984 Tachibana ..... B41F 27/105 101/375
4,685,393 A * 8/1987 Saueressig ..... B41F 13/10 101/375
6,647,879 B1 * 11/2003 Papadopoulos ..... B41F 13/10 101/329
2002/0002920 A1 * 1/2002 Dilling ..... B29C 44/1242 101/368
2011/0146514 A1 * 6/2011 Muller ..... B41F 17/002 101/368

FOREIGN PATENT DOCUMENTS

JP 51-123575 A 6/1986
JP 04-105942 A 4/1992
JP 09-207308 A 8/1997
JP 2003-182767 A 7/2003

* cited by examiner

*Primary Examiner* — David Banh
(74) *Attorney, Agent, or Firm* — McDermott Will & Emery LLP

(57) ABSTRACT

A printing mechanism 1 including a mandrel 2, and a tubular sleeve 3; wherein the mandrel comprises a main body and sleeve support members 6, a plurality of the sleeve-support members being arranged on the main body at intervals in the axial direction; and wherein the sleeve-support member has a plurality of arm portions 7 extending radially so as to support the sleeve from an inside thereof, and moving mechanisms 8 for moving tip vicinities of the arm portions inward/outward in the radial direction; and wherein the sleeve-support member has an interlock mechanism 9 for synchronously driving each moving mechanism of the sleeve support members, the tip vicinities of the arm portions being engaged with the inner surface of the sleeve or released from the engaged inner surface of the sleeve by the synchronous motion of the tip vicinities of all arm portions inward/outward with the interlock mechanism.

5 Claims, 8 Drawing Sheets

PRINTING MECHANISM

BACKGROUND OF THE INVENTION

Field of the Invention

The present invention relates to a printing mechanism having a mandrel and a sleeve to be mounted on the mandrel. More particularly, the present invention relates to a printing mechanism having a mandrel and a variety of sleeves having outer peripheral surface to which printing plates are attached.

Description of the Related Arts

Conventionally, as a method of mounting a printing plate on a mandrel of a printing mechanism, there has been such a widely used method that a thin plate cylinder (sleeve) having the same length as the axial length of the mandrel is mounted and then printing plates are attached to the sleeve.

The sleeve is a cylindrical member molded of plastic or FRP or the like. The mandrel is pivotally supported by bearings at both ends thereof. Therefore, when the sleeve is mounted on the mandrel, the bearing of the handle-side of the mandrel is opened while holding the mandrel by the bearing of the drive-side in a canti-lever manner, and then a sleeve having the same axial length as the mandrel is inserted onto the mandrel from the open side. Blowout ports of air are formed in the mandrel; three at the both ends thereof respectively, three at the center thereof. Therefore, when mounting a sleeve to the mandrel, compressed air is sent into the mandrel so as to blow out air from the holes provided on the surface of the mandrel.

Since the inner diameter of the sleeve is substantially same as the outer diameter of the mandrel, an air layer is formed between the inner surface of the sleeve and the outer surface of the mandrel by air pressure. Hence, the insertion resistance of the sleeve is reduced, making it possible to push the sleeve easily up to the full width of the mandrel.

And then, the concave notch formed on the front end of the inserted sleeve is fitted to the convex portion provided on the surface of the mandrel, so that the positioning in the circumferential direction and axial direction of the sleeve on the mandrel is performed, restricting the movement of the sleeve in the circumferential direction and the axial direction at the same time. Finally, the filling of air into the mandrel is stopped.

Patent Document 1 discloses a manner for engaging the sleeve with the shaft, such as a mandrel. In the sleeve and flexographic printing axis of Patent Document 1, the diameter in the vicinity of both ends in the axial direction is different about 2 mm, respectively, being formed to be a so-called-conical shape with gentle slope. Thus the sleeve is engaged so as to be pressed and fixed to the flexographic printing shaft. Moreover, a key is provided on the inner surface of the sleeve, and in the outer surface of the flexographic printing shaft, a groove engaging with said key is formed. By the engagement of those key and groove, the positioning of the flexographic shaft and the sleeve, the restriction of slip in the circumferential direction are performed.

Furthermore, Patent Document 2 discloses a large bag accommodating a plurality of small bags in each of which toilet paper rolls, kitchen towels and tissue paper and so on are filled.

PATENT DOCUMENTS

[Patent document 1] Japanese Patent Publication No. H09-207308;

[Patent document 2] Japanese Patent Publication No. 2003-182767

SUMMARY OF THE INVENTION

Problem to be Solved by the Invention

For example, print length change can be performed by replacing the sleeve already mounted on the printing mechanism with another sleeve having different outer diameter, that is, having different sleeve thickness. In the replacement of such a sleeve, by forming an air layer between the inner surface of the sleeve and the outer peripheral surface of the mandrel, the sleeve is mounted on the mandrel and is removed from the mandrel. However, since the sleeve is long, the bulk thereof is large and also the weight is heavy. For example, in a bag for heavy duty packaging of 10~30 kg, the width (in an opened state of the bag before being made into a cylindrical shape) is about 2000 mm. And the axial length of the sleeve to be mounted is as long as about 2000 mm. Further, since the print length becomes larger, the diameter of the sleeve becomes about 140 mm, which is large. Therefore, even when an air layer is formed, the operator requires a lot of working time to replace the sleeve by hand, and the work is dangerous because the sleeve is heavy.

When the printing length to be changed becomes large, instead of changing to a sleeve of different thicknesses, it is performed to increase the inner diameter itself of the sleeve. In this case, it must be replaced with each—mandrel. However, when replacing each mandrel, according to the number of print colors, it is necessary to prepare the mandrels of the same print length as many as the number of colors. Furthermore, the mandrel is a precision device, it costs much. For this reason, to replace the sleeve together with each mandrel costs much.

As described above, such work for the replacement of the sleeve has decreased the operating time of the printing mechanism, and has decreased the productivity of the printing mechanism, and has been uneconomical.

Then, the present invention aims at providing a printing mechanism in which sleeves can be easily mounted on a mandrel, or can be easily dismounted from the mandrel.

Means to Solve the Problem

The printing mechanism of the present invention (claim 1) is a printing mechanism including a mandrel, and a tubular sleeve to be mounted on the mandrel, having an outer peripheral surface to which printing plates are attached, in which the mandrel comprises a main body and sleeve support members arranged on an outer periphery of the main body; a plurality of the sleeve-support members being arranged on the main body at intervals in the axial direction; and in which the sleeve-support member has a plurality of arm portions radially extending so as to support the sleeve from an inside thereof and moving mechanisms for moving tip vicinities of the arm portions inward/outward in the radial direction; and in which the sleeve-support member also has an interlock mechanism for synchronously driving each moving mechanism of the sleeve-support members, the tip vicinities of the arm portions being engaged with the inner surface of the sleeve or released from the engaged inner surface of the sleeve by the synchronous motion of the tip vicinities of all arm portions inward/outward with the interlock mechanism.

In addition, in order to connect mutually the plurality of the sleeve support members, the printing mechanism is preferably provided with a connecting member extending along the body, in which the connecting member is connected with one of the tip vicinities of the arm portions among the plurality of arm portions of each of the sleeve support member (claim 2).

Each sleeve-support member is preferably provided with a base portion connected with the main body, the vicinity of the base end of the arm portion being pivotally supported swingably to the base portion, and the vicinity of the front end being swingably pivotally supported to the connecting member, and in which the sleeve support member comprises a plurality of pairs in which each pair-consists of adjoining sleeve support members, and in which the interlock mechanism is that which makes the both base portions of each pair of sleeve support member approach or separate, the tip vicinities of the arm portions being moved inward/outward radially by the approach or the separation of those bases portions (claim 3).

In addition, the moving mechanism is preferably a hydraulic cylinder to extend and retract the arm portions (claim 4).

Effect of the Invention

The printing mechanism according to the present invention (claim 1) can provide a clearance easily between the inner surface of the sleeve, by moving the tip vicinity of the arm portion inward in the radial direction. Therefore, it is easy to insert the sleeve onto the mandrel or to pull out it. Further, facilities for blowing out air such as those needed in the prior art is not necessary. In addition, since the tip vicinity of the arm portion is moved in the radial direction, a sleeve of different inner diameter can be mounted on the mandrel. Therefore, it is not necessary to provide mandrels of a number of outside diameters as those needed in the prior art. Furthermore it is possible to save the troublesome work to replace a sleeve by each mandrel. In addition, since each arm portion of the plurality of sleeve-supports arranged at axially spaced intervals, each arm portion is moved synchronously and inter-connectedly in the radial direction by the interlock mechanism, all arm portions move integrally. Therefore it is possible to prevent the center axis of the sleeve from out of alignment with the rotational axis of the body. Moreover, as compared with prior mandrels having the same diameter, the weight of the mandrel can be reduced.

In addition, in order to connect mutually the plurality of sleeve supports members, there is provided a connecting member extending along the body. In the case that the connecting member is connected with one of the tip vicinity of the arm portion among the plurality of arm portions of the respective sleeve support member (claim 2), the load applied to the sleeve by the connecting member, in other words, the load in a direction perpendicular to the axial direction of the mandrel, can be integrally supported.

Moreover, each of the sleeve support member is equipped with a base portion provided in the body, the vicinity of the base ends of the arm portion is pivotally supported swingably to the base portion, the tip vicinity thereof is pivotally supported swingably to the connecting member, the sleeve support members are made into a plurality of pairs consisting of one pair of adjoining sleeve support members. The interlock mechanism makes the both base portions of each pair of sleeve support members approach or separate. In the case that the tip vicinity of the arm portion is moved inward/outward radially by the approach and the separation of the base portion (claim 3), the arm portion can be synchronized by a simple mechanism.

Further, in the case that the moving mechanism is a hydraulic cylinder to extend—and retract the arms portions (claim 4), the arm portions can be moved radially by a simple mechanism.

DETAILED DESCRIPTION OF THE EMBODIMENTS

Figure 2:
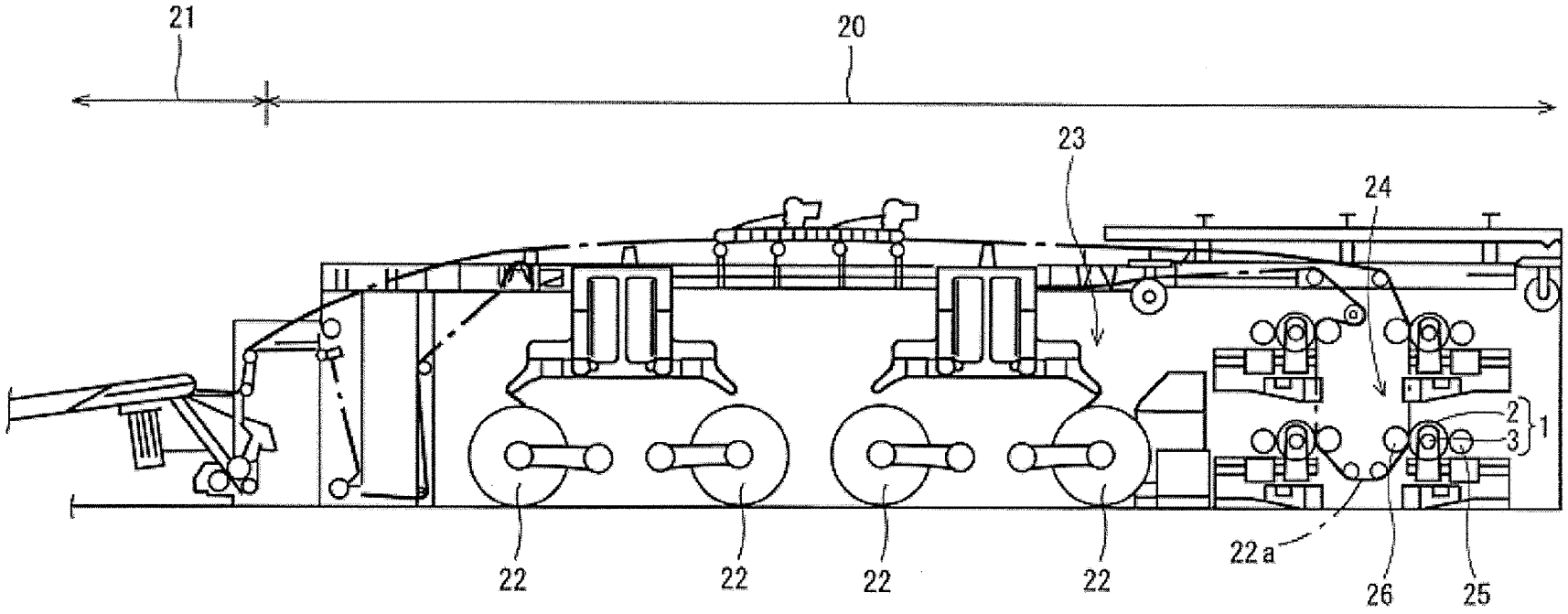
FIG. 2 is a schematic diagram showing a part of a manufacturing line of bags, in which the printing mechanism is employed.

First, with reference to FIG. 2, an outline of a manufacturing line of bags which has a printing mechanism 1 of the present invention is described. In FIG. 2, a printing line 20 which is a part of the manufacturing line of bags, and an overlay line 21 for superimposing the two sheets of base paper are shown.

The printing method in the printing line 20 with the printing mechanism 1 is flexographic printing. In the present embodiment, printing is performed by flexographic printing on a belt-like base paper before being made into a bag. In the figure, a double bag equipped with an inner bag and an outer bag is manufactured, but the bag of single-layer or three or more layers may be produced. Moreover, —in the case of multiple layers, printing is performed on a belt-like base paper to be an outside bag.

In addition, as the bag which is manufactured using the printing mechanism 1, it may be a packaging body for packaging a set of toilet paper rolls, for example, 8 rolls, 12 rolls, or a larger bag to package together a plurality of them. And further, it may be a heavy duty bags for packaging together a plurality of bags filled with kitchen paper rolls, tissue paper, and the like. Moreover, it may be a paper bag or a bag made of synthetic resin or the like, such as shopping bags. In the present invention, as the printing method, not only a flexographic printing but also similar printing methods can be used. Furthermore, paper, synthetic resin, film made of synthetic resin, cloth or non-woven fabric can be selected as the material of the bag used for printing.

The printing mechanism 1 comprises a cylindrical mandrel 2 and a tubular sleeve 3 which is mounted on the circumferential surface of the mandrel 2. On the outer circumferential surface of the sleeve 3, plates (flexographic plates 4, see FIG. 1A) pressed to the printing object (base paper) is attached. The sleeve 3 is of a conventionally known one which is formed of a layer such as a single layer or a plurality of layers of synthetic resin, and the like. Moreover, the flexographic plate 4 is of a conventionally known one to be formed of synthetic resin or the like. The flexographic plates 4 are attached to a transparent film. As the print object to be printed by the flexographic printing in the present embodiment, several kinds of paper products such as paper bags, cardboards, envelopes and notebooks, liquid paper containers such as a carton of milk, and a synthetic resin film used for plastic bags, pet food bags, paper diaper bags, and the like can be cited. Typically, the flexographic printing plate 4 is set on a transparent film, but the flexographic plate 4 may be attached directly on the sleeve 3.

The printing line 20 is provided with a paper feeder 23 which pivotally supports a roll 22 on which a base paper 22*a* of a bag is wound, and a base paper feeder 23 which feeds the base paper 22*a*, and a printing machine 24 which prints on the base paper 22*a* continuously supplied from the paper feeder 23. In the figure, four rolls 22 are pivotally supported on the paper feeder 23. The right end roll 22 in the figure is of a base paper for an outer bag, and is sent to the printing line 20. The left end roll 22 is of a base paper for an inner bag, and is sent to the overlay line 21. Two rolls 22, 22 in the center are waiting for replenishing the rolls 22, 22 of the right and left ends.

The printing machine 24 is provided with a mandrel 2 on which a sleeve 3 is mounted—(printing mechanisms 1), an anilox roll 25 and the impression cylinder drum 26 each having a rotation axis parallel to the rotational axis of the mandrel 2. Each of these mandrel 2, anilox roll 25, and impression cylinder drum 26, is motor driven and is synchronized.

The anilox roll 25 is in contact with the flexographic plate 4 which is attached to the sleeve 3, and supplies ink to the flexographic plate 4. The impression cylinder drum 26 is located at the opposite side of the anilox roll 25 in regard to the mandrel 2. The impression cylinder drum 26 is pressed somewhat to the mandrel 2 side so as to sandwich the base paper 22*a* between the mandrel 2 and the impression cylinder drum 26 in order to transfer the ink painted on the flexographic plate 4 (print pattern) to the base paper 22*a*, thereby printing is performed.

Figure 1A:
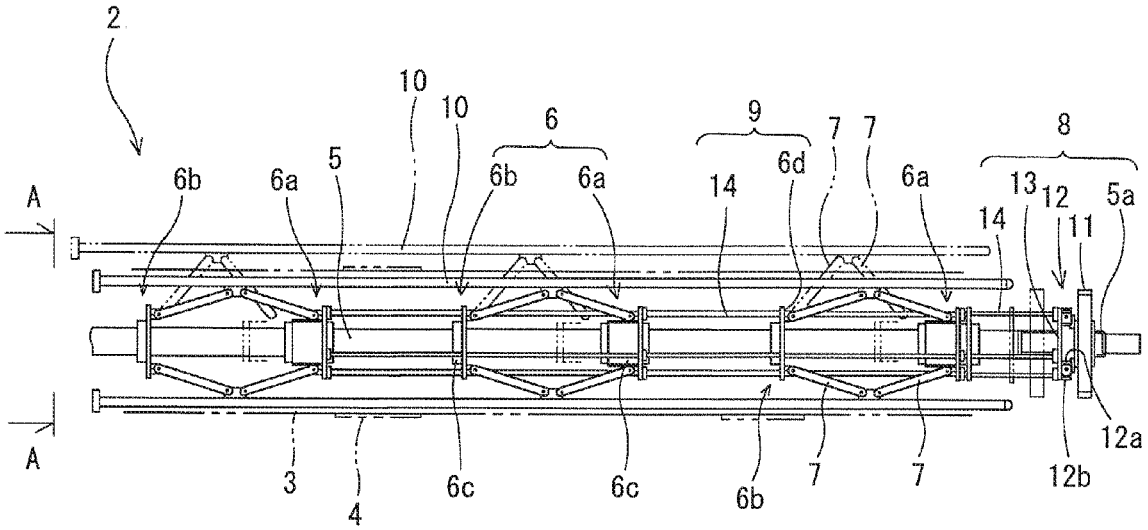
FIG. 1A is a schematic view of a mandrel used in the printing mechanism of the present invention.
Figure 1B:
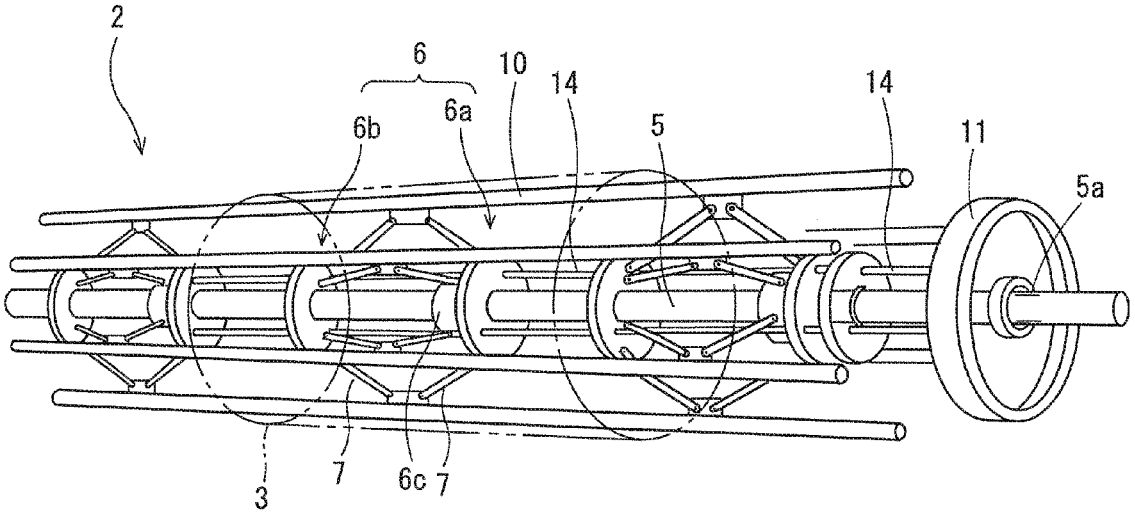
FIG. 1B is a schematic perspective view of the mandrel of FIG. 1A.
Figure 3A:
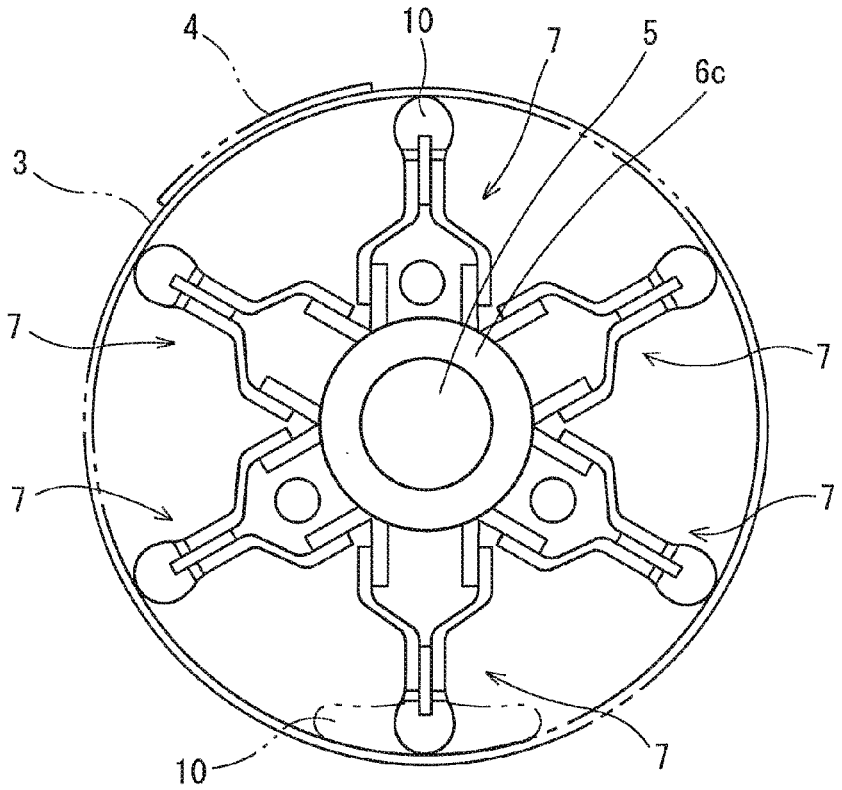
FIG. 3A shows across sectional view of A-A arrow in FIG. 1A.

An outline of the mandrel 2 is described with reference to FIGS. 1A and 1B. The mandrel 2 shown in the figures is equipped with a main body 5. Both ends of the main body 5 is pivotally supported by bearings (not shown) of the printing machine 24. One end of which is connected to a drive unit such as a motor, whose rotational force is transmitted thereto. The main body 5 is provided with a plurality of sleeve supports 6, 6 . . . arranged at intervals. In the figure, there are provided six sleeve supports 6. Each sleeve support 6, as shown in FIG. 3A is provided with six arm portions 7, 7 . . . extending outward radially. Each sleeve support 6 further has a moving mechanism 8 which moves the position of the tip of the arm portion 7. Moreover, the mandrel 2 is provided with an interlock mechanism 9 to synchronously operate all of each moving mechanism 8 of the sleeve supports 6, 6. Further, a connecting member 10 is connected to the tip of the arm portion 7.

The main body 5 engagingly stops the sleeve 2, and rotates integrally with the sleeve 2. Further, in this embodiment, the body 5 is cylindrical, and the inside thereof is made to be a cavity.

The sleeve support member 6 is used so as to be a plurality of pairs making the adjoining sleeve support 6 to be one pair. And it is used so as to be three pairs in the present embodiment. To describe in the rightmost pair of FIG. 1A, the right end of the sleeve support 6 and the adjoining-sleeve support 6 in the left side are one pair.

Each sleeve support 6 has a base portion 6*c* provided on the main body 5. The vicinity of base end of the arm portion 7 is pivotally supported swingably to the base portion 6*c*. In this embodiment, there are two types of the base portion 6*c*. One type of the base portion 6*c* of the right end of the sleeve support 6 exhibits a cylindrical shape, and is passed through the outer periphery of the main body 5 and is movable freely in the axial direction. The sleeve support having the freely movable base portion 6*c* is made so as to be a moving sleeve support 6*a*. Meanwhile, the base portion 6*c* of the sleeve support 6 of the left side is fixed to the main body 5 and does not move. This sleeve support is made so as to be a fixed sleeve support 6*b*.

A rod 14 to be described later, extending in parallel to the main body 5, is connected to the moving sleeve support 6*a*. The rod 14 moves the moving sleeve support 6*a* in the axial direction. Meanwhile, in the fixed sleeve support 6*b*, a through holes 6*d* is formed, the rod 14 penetrating therein. Hence, the fixed sleeve support 6*b* does not disturb the movement of the rod 14 in the axial direction.

Six arm portions 7 are provided in each sleeve support 6. Those arm portions 7 extend radially in side view (see FIG. 3A) at intervals of substantially equal angle (60 degree) in the circumferential direction from the base portion 6*c* of the sleeve support 6. The arm portions 7 of each sleeve support 6 extend in the same-direction radially. Hence, the tip portions of the adjoining arm portion 7 are arranged side by side on a substantially straight line in the axial direction of the body 5. In addition, as shown in FIG. 1A, the arm portions 7 of six places of the sleeve support 6 extend like inverted v shape with their tip portions of the arm portions 7, 7 of one pair in front and behind facing each other. Further, three to twelve of the arm portion 7 are preferably provided to one of the sleeve support 6.

Figure 3B:
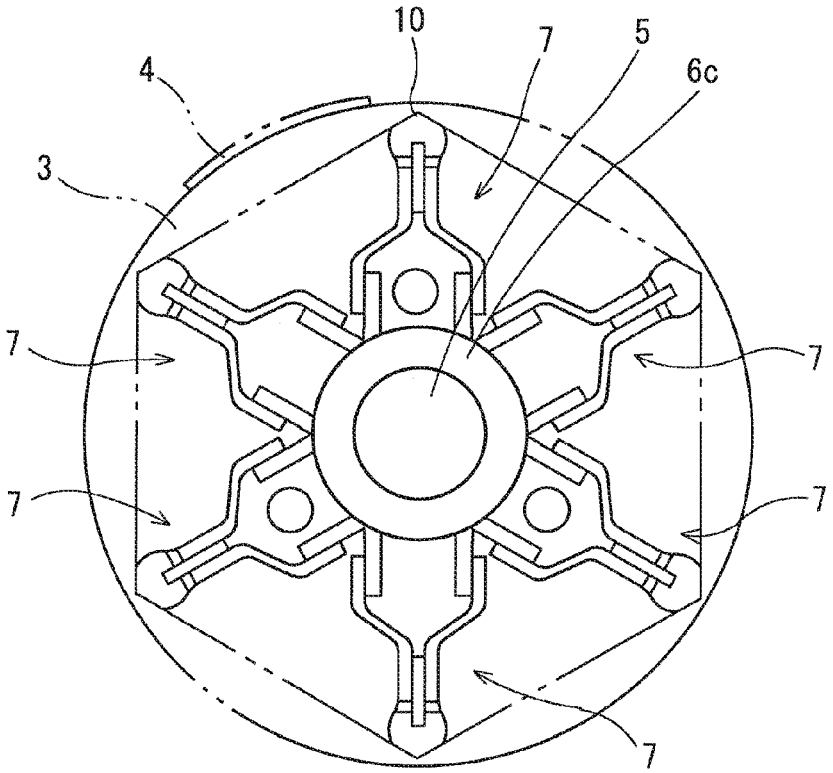
FIG. 3B is a schematic diagram showing another embodiment of a printing mechanism of the present invention.

As shown in FIG. 3A, in this embodiment, the respective arm portion 7 of the sleeve supports 6, 6 . . . , that is, the tip vicinity of the arm portion in a line in the axial direction is connected to—the connecting member 10. Those connected arm portions 7 are rotatable freely in regard to the connecting member 10. The number of the connecting member 10 is the same number as the number of the arm portions 7 which each sleeve support member 6 has, that is, six in this embodiment. The cross-sectional shape of the connecting member 10 is substantially circular. Other than substantially circular, the above-mentioned cross sectional shape may be formed into such a shape that a portion which is in contact with the inner circumferential surface of the sleeve 3 forms a smooth curved line such as ellipse (see two-dot chain line in FIG. 3A). Further, FIG. 3B shows another embodiment of the printing mechanism 1. The cross-section of the inner surface of the sleeve 3 in this embodiment, is formed into a regular polygon (a regular hexagon in the figure). Then, the cross-sectional shape of the connecting member 10 is formed into such a shape that is provided with an exterior angle portion having an apex angle (120 degree in the figure) to fit the interior angle portion of the inner surface of the sleeve. Consequently, even if the sleeve 3 is made to have a larger diameter or a smaller diameter, the exterior angle portion of the connecting member 10 can be securely fitted to the interior angle portion of the sleeve 3. Further, as long as the shape of the exterior angle portion of the connecting member 10 is made so as to fit the inner angle of the corresponding sleeve 3, the angle of the interior angle portion of the sleeve 3 is not always necessary to be formed into the same angle.

Further, there is provided the connecting member 10 in this embodiment, but without providing the connecting member 10, it may be composed so that one pair of tip vicinity portion of the arm portions 7, 7 are mutually connected freely rotatably directly, and that the inner surface of the sleeve 3 is directly supported by the outer surface of the connecting portion. In that case, it is preferable to provide a plate-like member which can contact—the inner surface of the sleeve 3 with the large area of the sleeve 3 in the connecting portion. And, the cross-sectional shape of the plate-like member is preferably formed into a curved shape so as to be along the inner surface of the sleeve 3 as far as possible.

Returning to FIG. 1A, on the outer peripheral surface near the right end of the body 5, a male screw 5*a* is formed. In the male screw 5*a*, a handle 11 in which a female screw is formed is screwed. In the left side of the handle 11, a rod connecting body 13 is provided through an intermediate member 12. To the rod connecting body 13 the left ends of the three rods 14 are connected, the left end side of the rod 14 extends in parallel to the axial direction. These male screw 5*a*, handle 11, intermediate member 12, rod connecting body 13 and rod 14 and the like constitute a moving mechanism 8. Among the members in the rod 14, from the rod connecting body 13 to a part connected to the moving sleeve support 6*a* of the right end of the sleeve support member 6 are the members constituting the moving mechanism 8.

The handle 11 moves the vicinity of the right end of the main body 5 to the axial direction (right and left direction in the figure) by a screw mechanism. The intermediate member 12 is doughnut-shaped, and the main body 5 penetrates through a central hole thereof. The intermediate member 12 is movable freely on the circumferential surface of the main body 5 in the axial direction. The intermediate member 12 is a bearing provided with an inner member 12*a* and the outer member 12*b*. The both members 12*a*, 12*b* are rotatable in regard to each other. Moreover, in the center of the rod connecting body 13, a hole is formed in the center thereof, and the main body 5 penetrates through the hole. The rod connecting body 13 is movable freely along the circumferential surface of the main body 5 in the axial direction. The handle 11 is connected to the inner member 12*a* of the intermediate member 12, and the rod connecting body 13 is connected with the outer member 12*b* of the intermediate member 12. Hence, the rotational force is not transmitted between the handle 11 and the rod connecting body 13. A closed link consisting of these both bases 6*c*, 6*c*, arms 7, 7 and connecting member 10 constitutes the moving mechanism 8.

The interlock mechanism 9 is composed of a through-hole 6*d* of the fixed sleeve support member 6*b* and the rod 14. Among the rod 14, the portion which extends to the left side from the moving sleeve support 6*a* of the right end sleeve support 6 member constitutes the moving mechanism 8. The rod 14 is passed through the through-hole 6*d* of the fixed sleeve support 6*b*. Therefore, the force applied to the moving sleeve support member 6*a* is not transmitted to the fixed sleeve support 6*b*. Hence, each pair of the moving sleeve support 6*a* can be moved in synchronization.

Figure 4A:
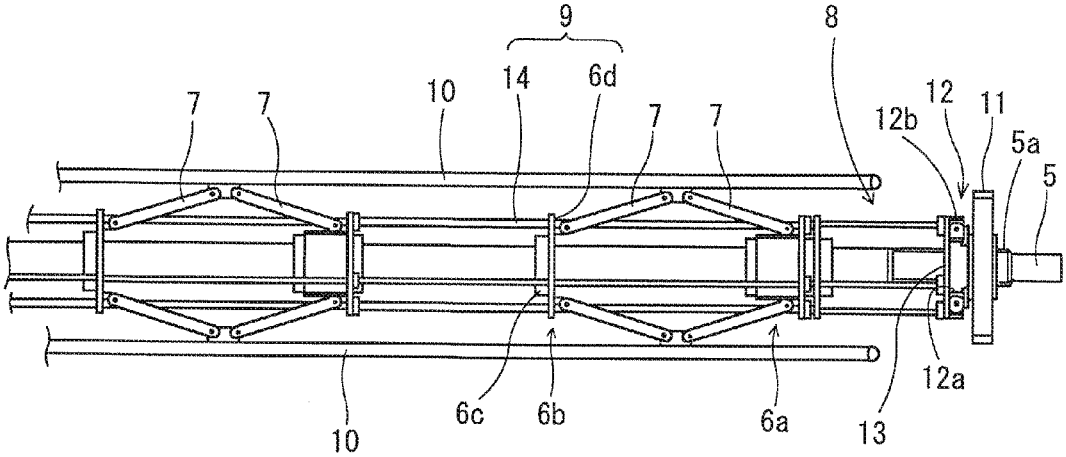
FIG. 4A is a schematic operational view showing a state in which the tip vicinities the arm portions are moved inward radially.

Next, referring to FIG. 4A, the manner in which the tip vicinity of one pair of arm portions 7, 7 projects radially outward is described. First, by rotating the handle 11, the handle 11 is screwed toward the left side of the main body 5. The intermediate member 12 is moved together with the handle 11 to the left side. To the outer member 12*b* of the intermediate member 12, the rod connecting body 13 is fixed. Hence, the rotational force from the handle 11 is not transmitted to the rod connecting member 13, and the rod 14 does not rotate, because it is supported by the through-hole 6*d* of the fixed sleeve support 6*b*. Thus, the rod 14 moves the main body 5 to the left side together with the handle 11 and the intermediate member 12. As a result, the rod 14 moves to the left side in the axial direction, and moves the moving sleeve support 6*a* to the left side. When the moving sleeve support 6*a* moves to the left side, and comes closes to the fixed sleeve support 6*b*, both the base end portion of the arm portions 7, 7 extending from the sleeve supports 6*a*, 6*b* come close mutually, and the angle between the tip vicinities of the arm portions 7 and 7 narrows. Thereby, the tip side of the arm portions 7, 7 projects outward in the radial direction (see FIG. 4B). Further, the other pairs of the moving sleeve support 6*a*, similar to that described above, by moving to the left side by the rod 14, projects the arm portion 7 outward in the radial direction.

Figure 4B:
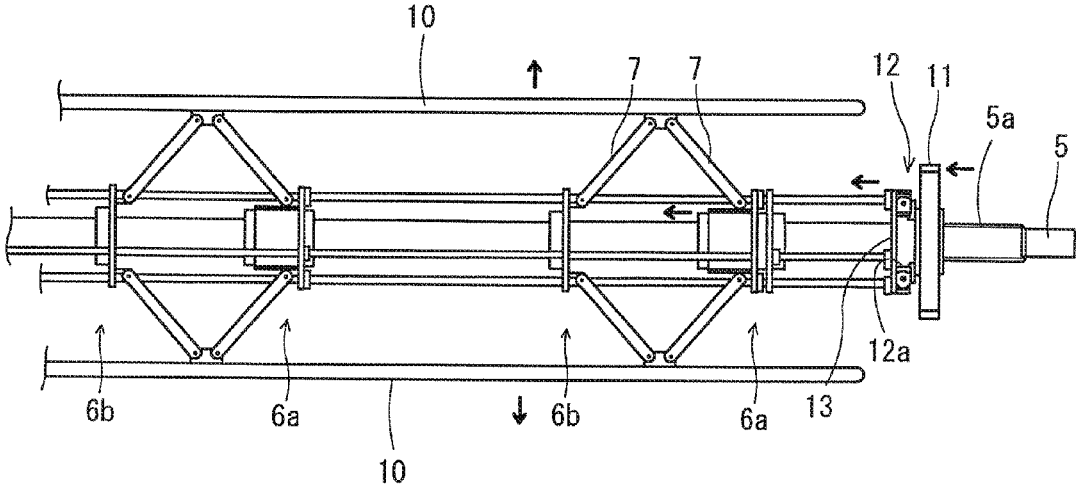
FIG. 4B is a schematic operational view showing a state in which the tip vicinities of the arm portions are moved-outward radially.

Next, referring to FIG. 4B, the manner in which the tip vicinity of the the one pair of arm portions 7, 7 moves radially inward is described. When the handle 11 is rotated in the opposite direction, and is screwed toward the right of the main body 5, the handle 11, intermediate member 12, the rod connecting body 13 and the rod 14 move to the right side in regard to the main body 5. Hence, the moving sleeve support 6*a* fixed to the rod 14 moves to the right side. When the moving sleeve support 6*a* separates from the fixed sleeve support 6*b*, the base end portions of the arm portions 7, 7 extending from the both sleeve supports 6*s*, 6*b* become more distant mutually. Then, the angle between the tip vicinity of the arm portions 7, 7 spreads, and the tip side of the arm portions 7, 7 moves inward in the radial direction. Moreover, the other pairs of the moving sleeve support 6*a* also move to the right side of the main body 5 together with the rod 14, as described above, thereby the tip vicinity of the arm portion 7 is moved inward in the radial direction.

Here, the moving mechanism 8 is that which moves the tip vicinity of the arm portion 7 inward or outward in the radial direction. Further, in the present embodiment, the length of each pair of arm portions 7, 7 is made to be same. Furthermore, the distance between the base ends is made longer than the distance between the tips. Thereby, when the one pair of the sleeve support 6*a*, 6*b* is made to become close, the arm portions 7, 7 move that much in a direction approaching mutually as a whole, and swing around the base end of the arm portions 7, 7 with the tip side thereof rising up, making those tip ends protrude radially outward.

Figure 5:
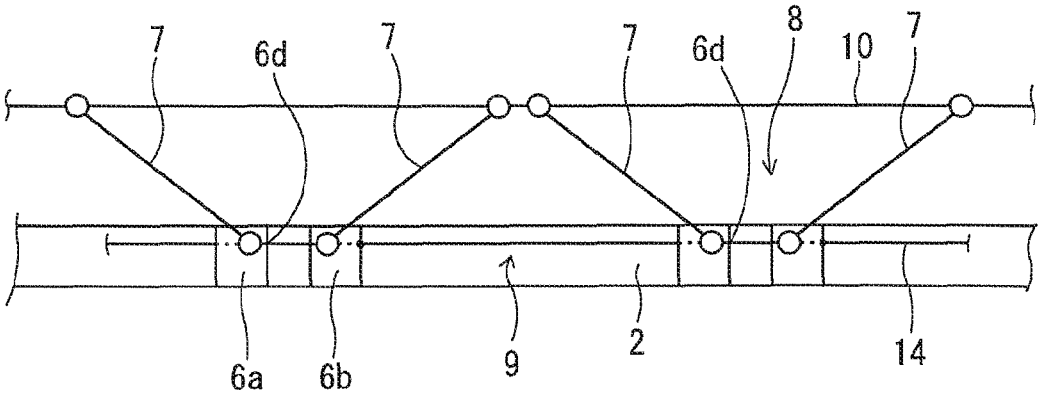
FIG. 5 is a partially enlarged schematic view showing another embodiment of the present invention.

In addition, in the case that the distance between the base ends is made shorter than the distance between the tips, the arm portions 7, 7, for example, as shown in FIG. 5, is provided in the shape of inverted v, the tip vicinity of—the arm portion 7 can be protruded radially outward by the separation of the one pair of the sleeve supports 6*c*, 6*c*.

Figure 6A:
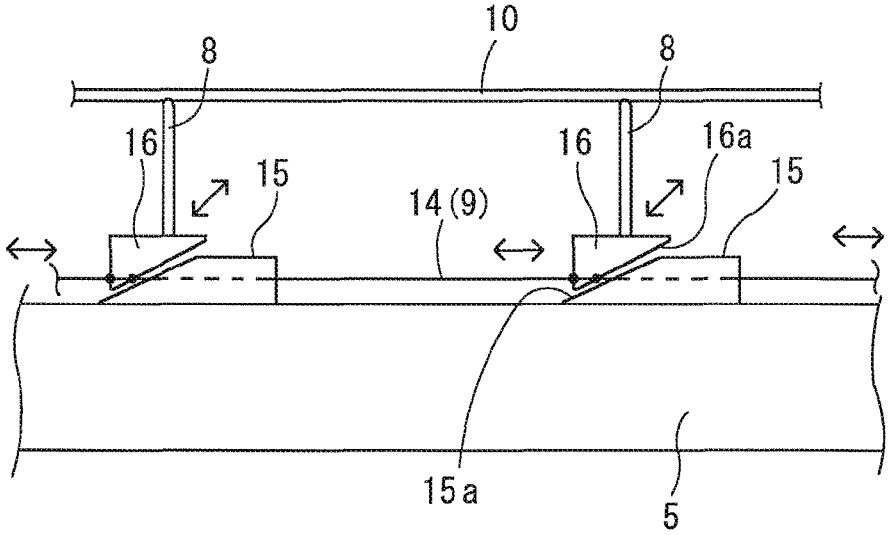
FIG. 6A is a partially enlarged schematic view showing further another embodiment of the present invention.

Another embodiment of the present invention is shown in FIG. 6. In this embodiment, a cam mechanism is used as the moving mechanism 8. Note that to the part in common with the moving mechanism of FIG. 1A, the same reference numerals as that of FIG. 1A are assigned, omitting the description thereof. As shown in FIG. 6*a*, a plurality of inside blocks 15 are mounted on the main body 5 and are arranged in the axial direction. In the inside block 15, a slope 15*a* descending toward the left edge is formed on the upper surface thereof. Meanwhile, to the connecting member 10, a plurality of outside blocks 16 is provided through the arm portion 7. In those outside blocks 16, a slope 16*a* descending toward the left edge, which contacts the slopes 5*a* of the outside block 15*a* is formed. Those outside blocks 16 are connected to the rod 14 and are integrated. Hence, when the rod 14 moves right and left in the axial direction, also the outside block 16 moves right and left. When the outside block 16 moves right, the outside block 16 climbs the slope 15*a* of the inside block in the upper right direction. Thereby, the arm portion 7 and the connecting member 10 connected to the tip of the arm portion projects radially outward, and can support the sleeve 3 from the inner surface. And by the contact of the slope 15*a* of the inside block and the slope 16*a* of the moving block, it is possible to support an inward load in the radial direction transmitted from the outside block 16 to the inside block 15. On the other hand, when the outside block 16 is moved left, the outside block 16 descends the lower slope 15*a* of the outside block. Then, the outside block 16 moves inward in the radial direction. Hence, the engagement between the sleeve 3 and the connecting rod 10 is released. Moreover, without providing the connecting member 10, it is also possible to support directly the inner surface of the sleeve 3 at the tip of the arm portion 7. Further, without providing the arm portion 7, the inner surface of the sleeve 3 may be supported by the outer surface of the outside block 16 directly.

Figure 6B:
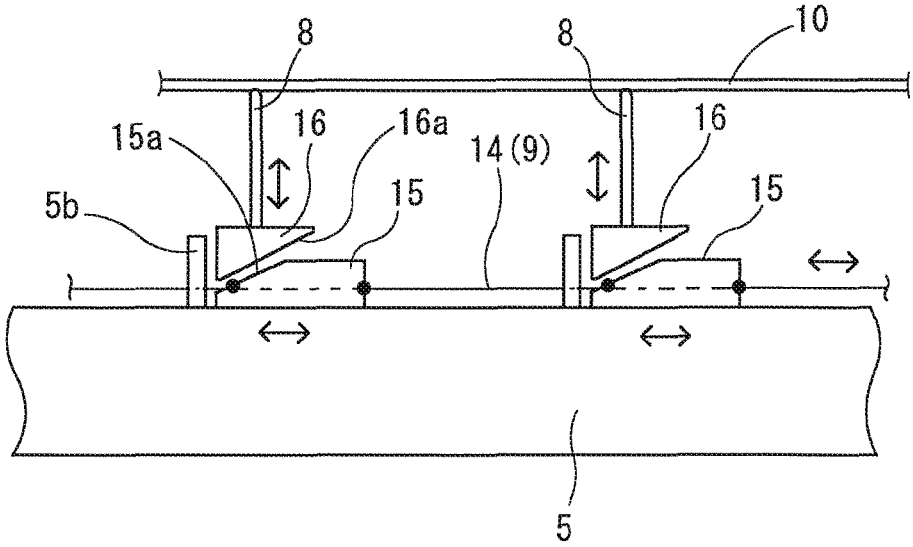
FIG. 6B is a partially enlarged schematic view showing further another embodiment of the present invention.

Further, as shown in FIG. 6*b*, the movement of the outside block and the inside block may be turned upside down. That is, by moving the inside block 15 in the axial direction, the outside block 16 is moved in the radial direction. In this case, by the axial direction movement of the inside block 15, the outside block 16 is moved in the radial direction. In this case, a check plate 5*b* is preferably provided in the main body 5, so that the outside block 16 is not pushed in the axial direction and so that the upward movement of the outside block 15 is helped.

A driving source for moving the rod 14 in the axial direction can be obtained by a conventionally known method. For example, an electric motor may be used in place of the handle 11. The rotary motion of the motor may be converted into movement in the axial direction by a screw mechanism or a pinion rack mechanism, and may be transmitted to the rod 14. Further, the pneumatic or hydraulic cylinders may be used to move the rod 14 in the axial direction. Moreover, it is possible to support directly the inner surface of the sleeve 3 by the tip of the arm portion 7, without providing the connecting member 10. Furthermore, the inner surface of the sleeve 3 may be supported by the outer surface of the outside block 16 directly, without providing the arm portion 7.

Figure 7:
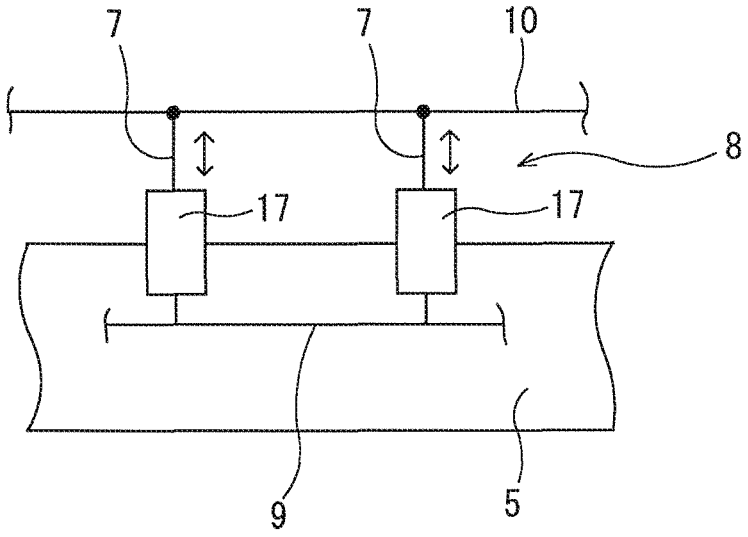
FIG. 7 is a partially enlarged schematic view showing further another embodiment of the present invention.

As shown in FIG. 7, the rod of a hydraulic cylinder using oil or pneumatic pressure may be used in the arm portion 7. In this case, the moving mechanism 8 is the hydraulic cylinder, and a hydraulic or a pneumatic circuit corresponds to the interlock mechanism 9. In this embodiment, the main body 5 is provided with a plurality of hydraulic cylinders 17. And the arm portion 7 as the cylinder rod is provided to be freely expandable and retractable by the oil or pneumatic pressure. Moreover, in this embodiment, it is possible to directly support the inner surface of the sleeve 3 by the tip of the arm portion 7, without providing the connecting member 10.

Figure 8:
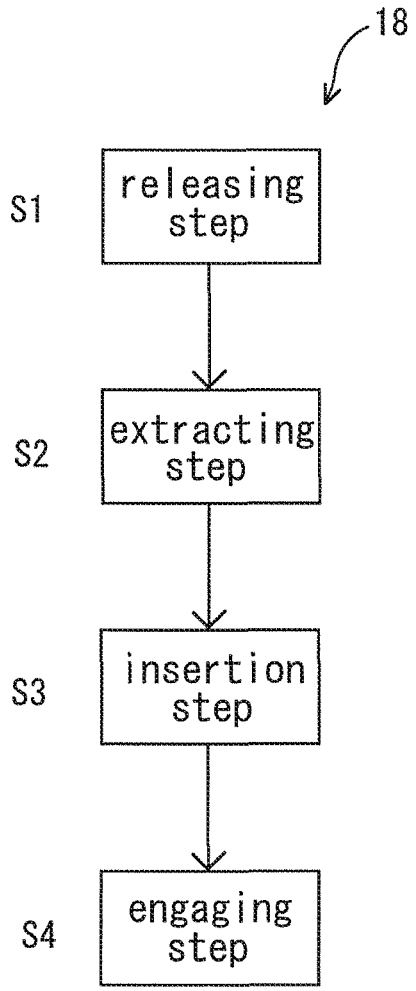
FIG. 8 is a flow chart showing a method to replace the sleeve using a printing mechanism of the present invention.

FIG. 8 is a flow chart showing a method of replacing the sleeve using a printing mechanism of the present invention. A replacing method 18 comprises a releasing step to release the engagement between the sleeve 3 and the mandrel 2 (S1), an extracting step to pull out the sleeve 3 (S2), an insertion step to insert a replacement sleeve 3*a* (S3), and an engaging step to engage the replaced sleeve 3*a* with the mandrel (S4).

Hereinafter, referring to FIGS. 1A and 1B also, the process will be described in detail. In the releasing step S1, firstly, the tip portion of the arm portion 7 is moved in the radial direction inward. Thereby, the engagement of the inner surface of the sleeve 3 with tip vicinity of the arm portions 7 or the outer surface of the connecting member 10 is released, making it easy to pull out the sleeve 3 from the mandrel 2. Then, the sleeve 3 is pulled out by the above extracting step S2. In this case, the extraction is easily performed, if it is done by pulling the sleeve 3 so as to slide along the outer surface of the connecting member 10 extending in the axial direction. In the insertion step S3, the replacement sleeve 3*a* is inserted onto the mandrel 2. When the inner diameter of the replacement sleeve 3*a* is small, the tip vicinity of the arm portion 7 is moved further inward. On the other hand, when the inner diameter of the replacement sleeve is larger, the tip vicinity of the arm portion 7 is moved somewhat outward, or is not moved as it is. The position of the tip vicinity of the arm portion 7 is, when passing through the replacement sleeve 3*a* to the main body 5 of the mandrel 2, preferably positioned so that can guide the replacement sleeve 3*a* smoothly. In the engaging step S4, the tip vicinity of the arm portion 7 is moved outward in the radial direction, the outer surface of the tip vicinity or the outer surface of the connecting member 10 is made to engage with the inner surface of the replacement sleeve 3*a*. At this time, since all the arm portions 7 are moved synchronously, the rotational axis of the main body 5 (the center axis)—and the center axis of the replacement sleeve 3*a* do not become misaligned.

EXPLANATION OF THE NUMERALS AND MARKS

1: printing mechanism, 2: mandrel, 3: sleeve, 4: flexographic plate (plate), 5: main body, 5*a*: male screw, 5*b*: check plate, 6: sleeve support member, 6*a*: moving sleeve support, 6*b*: fixed sleeve support, 6*c*: base portion, 6*d*: through-hole, 7: arm portion, 8 moving mechanism, 9: interlock mechanism, 10: connecting member, 11: handle, 12: intermediate member, 12*a*: inner member, 12*b*: outer member, 13: rod connecting body, 14: rod, 15: inside block, 15*a*: slope of inside block, 16: outside block. 16*a*: slope of outside block, 17: cylinder, 18: replacing method, 20: print line, 21 overlay line, 22: roll, 22*a*: base paper, 23: paper feeder, 24: printing machine, 24*a*: bearing, 25: anilox roll, 26: impression cylinder drum, S1: releasing step, S2: extracting step S3: insertion step, S4: engaging step

The invention claimed is:

1. A printing mechanism including a mandrel, and a tubular sleeve to be mounted on the mandrel, having an outer peripheral surface to which printing plates are attached;

wherein the mandrel comprises a main body and sleeve support members arranged on an outer periphery of the main body, a plurality of the sleeve-support members being arranged on the main body at intervals in the axial direction;

and wherein each respective sleeve-support member has a plurality of arm portions extending radially so as to support the sleeve from an inside thereof, and respective moving mechanisms for moving tip vicinities of the arm portions inward and outward in the radial direction;

and wherein each respective sleeve-support member further has an interlock mechanism for synchronously driving each moving mechanism of the sleeve support members, the tip vicinities of the arm portions being engaged with the inner surface of the sleeve or released from the engaged inner surface of the sleeve by the synchronous motion of the tip vicinities of all arm portions inward and outward with the interlock mechanism.

2. The printing mechanism according to claim 1, further comprising a connecting member extending along the main body in order to connect mutually the plurality of the sleeve support members, wherein the connecting member is connected with one of the tip vicinities of the arm portions among the plurality of arm portions of each of the sleeve support member.

3. The printing mechanism according to claim 2, wherein, each sleeve support member is equipped with a base portion provided on the main body, the vicinity of the base end of the arm portion being pivotably supported swingably to the base portion, and the tip vicinity thereof being pivotably supported swingably to the said connecting member, and wherein the sleeve support member is made to be a plurality of pairs in which each pair consists of adjoining sleeve support members, and wherein the interlock mechanism is that which makes the both base portions of each pair of sleeve support member approach or separate, the tip vicinities of the arm portions being moved inward and outward radially by the approach or the separation of those base portions.

4. The printing mechanism according to claim 1, wherein the moving mechanism is a hydraulic cylinder to extend and retract the arm portions.

5. The printing mechanism according to claim 2, wherein the moving mechanism is a hydraulic cylinder to extend and retract the arm portions.

* * * * *